US008944312B2

(12) United States Patent
Won et al.

(10) Patent No.: US 8,944,312 B2
(45) Date of Patent: Feb. 3, 2015

(54) PACKING BOX

(75) Inventors: Jin Sik Won, Suwon-si (KR); Jung Il Shim, Jeonju-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 625 days.

(21) Appl. No.: 13/288,186

(22) Filed: Nov. 3, 2011

(65) Prior Publication Data

US 2012/0153014 A1 Jun. 21, 2012

(30) Foreign Application Priority Data

Dec. 17, 2010 (KR) ..... 10-2010-0129810

(51) Int. Cl.

| | |
|---|---|
| ***B65D 5/43*** | (2006.01) |
| ***B65D 5/54*** | (2006.01) |
| ***B65D 5/02*** | (2006.01) |
| ***B65D 5/70*** | (2006.01) |
| ***B65D 5/10*** | (2006.01) |
| ***B65D 5/66*** | (2006.01) |

(52) U.S. Cl.

CPC ..... *B65D 5/0254* (2013.01); *B65D 5/701* (2013.01); *B65D 5/10* (2013.01); *B65D 5/6608* (2013.01); *Y10S 206/807* (2013.01)

USPC ..... 229/102; 206/807; 229/222

(58) Field of Classification Search

USPC ..... 229/102, 147, 151, 153, 222

See application file for complete search history.

(56) References Cited

U.S. PATENT DOCUMENTS

| | | | | | |
|---|---|---|---|---|---|
| 2,390,412 | A * | 12/1945 | Axberg | ..... | 229/222 |
| 2,685,400 | A * | 8/1954 | MacArthur, Jr. | ..... | 229/222 |
| 3,263,899 | A * | 8/1966 | Collura et al. | ..... | 229/222 |
| 3,462,066 | A * | 8/1969 | Farquhar | ..... | 229/102 |
| 3,662,945 | A * | 5/1972 | Foster et al. | ..... | 229/223 |
| 3,865,322 | A * | 2/1975 | Hennessey | ..... | 229/222 |
| 4,484,683 | A * | 11/1984 | Werner, Jr. | ..... | 229/222 |
| 4,830,270 | A * | 5/1989 | Holmes | ..... | 229/102 |
| 2006/0124708 | A1 * | 6/2006 | Lo Duca | ..... | 229/102 |
| 2007/0170234 | A1 * | 7/2007 | Cargile, Jr | ..... | 229/157 |
| 2007/0194091 | A1 * | 8/2007 | Lo Duca | ..... | 229/151 |
| 2010/0252618 | A1 * | 10/2010 | Adam et al. | ..... | 229/102 |

FOREIGN PATENT DOCUMENTS

| | | |
|---|---|---|
| BE | 393937 | 2/1933 |
| DE | 462933 | 7/1928 |
| EP | 1671888 | 6/2006 |

OTHER PUBLICATIONS

European Search Report Issued on May 7, 2012 in EP Patent Application No. 11188126.4.

* cited by examiner

*Primary Examiner* — Gary Elkins

(74) *Attorney, Agent, or Firm* — Staas & Halsey LLP

(57) ABSTRACT

A packing box includes a main body, an opening formed on one surface of the main body, left and right flaps extended from the left and right edges of the opening so as to cover the opening, a rear flap extended from the rear edge of the opening so as to be folded to the upper surfaces of the left and right flaps, an insertion flap extended from the front end of the rear flap so as to be inserted into an insertion hole, locking flaps extended from both sides of the insertion flap so as to maintain a closed state of the rear flap and unfolded to be supported by the left and right flaps after insertion of the locking flaps into the insertion hole, and fracture guide cutting lines formed at folded parts of the left and right flaps.

32 Claims, 20 Drawing Sheets

PACKING BOX

CROSS-REFERENCE TO RELATED APPLICATIONS

This application claims priority under 35 U.S.C. 119 of Korean Patent Application No. 10-2010-0129810 filed with the Korea Industrial Property Office on Dec. 17, 2010, the disclosure of which is incorporated herein by reference in its entirety.

BACKGROUND OF THE INVENTION

1. Field of the Invention

Embodiments of the present general inventive concept relate to a packing box which prevents unauthorized use and achieves repacking.

2. Description of the Related Art

In general, packing boxes for products are used to protect the products and increase convenience of conveyance of the products if the products to be packed need to be stored or transferred a long distance.

These packing boxes are generally formed of boards made of relatively low-priced paper. A packing box is made by selecting a proper paperboard according to an object to be packed and cutting and processing the selected paperboard to correspond to a size of the object and then properly assembling respective portions of the paperboard, thereby forming a receipt space.

Recently, if a high-priced object, such as a developing cartridge, is packed within a packing box, the packing box requires a structure to prevent illegal fraudulent use.

SUMMARY OF THE INVENTION

The present general inventive concept provides a packing box which prevents illegal fraudulent or unauthorized use and achieves repacking.

Additional aspects of the present general inventive concept will be set forth in part in the description which follows and, in part, will be obvious from the description, or may be learned by practice of the present general inventive concept.

The foregoing and/or other aspects and utilities of the present general inventive concept may be achieved by providing a packing box which may include a main body having a regular hexahedral shape to store and transport an object, an opening formed on one surface of the main body such that the object is inserted into the main body through the opening, a left flap and a right flap extended from the left and right edges of the opening in opposite direction to cover the opening, a rear flap extended from the rear edge of the opening to be folded to the upper surfaces of the left and right flaps, an insertion flap extended from the front end of the rear flap to be inserted into an insertion hole formed between the front edge of the opening and the side edges of the left and right flaps, locking flaps extended from both sides of the insertion flap to maintain a closed state of the rear flap, and unfolded to be supported by the left and right flaps after insertion of the locking flaps together with the insertion flap into the insertion hole, and fracture guide cutting lines having a designated length and formed at folded parts of the left and right flaps.

The insertion flap may have a width corresponding to a width of the opening.

The fracture guide cutting lines may be disposed at positions adjacent to the locking flaps.

A finger insertion hole cutting line may be provided on the rear flap.

Opening guide cutting lines extended from the finger insertion hole cutting line in leftward and rightward directions of the rear flap may be provided on the rear flap so as to separate the insertion flap from the rear flap.

The packing box may further include a front flap extended from the front edge of the opening so as to be foldable, and an insertion slot extended in the horizontal direction may be provided on the front flap so as to be cut along a cutting line.

A foldable fixed flap may be formed by the finger insertion hole cutting line, and the fixed flap may be inserted into the insertion slot.

The packing box may further include an elastic tape provided on the insertion flap and the locking flaps so as to traverse folded parts between the insertion flap and the locking flaps.

The elastic tape may include a shape memory material.

The elastic tape may be provided so as to apply elastic force in a direction of unfolding the locking flaps.

Elastic force of the elastic tape may be greater than elastic force of a material of the packing box.

The foregoing and/or other aspects and utilities of the present general inventive concept may also be achieved by providing a packing box which may include a main body provided with an opening formed on one surface thereof such that the object is inserted into the main body through the opening, a left flap and a right flap extended from the left and right edges of the opening opposite to each other to cover the opening, an insertion hole formed between the front edge of the opening and the side edges of the left and right flaps adjacent to the front edge of the opening, a rear flap extended from the rear edge of the opening to be foldable and contacting the upper surfaces of the left and right flaps, a front flap extended from the front edge of the opening to be foldable and provided with an insertion slot, an insertion flap extended from the front end of the rear flap to be foldable and inserted into the insertion hole, locking flaps extended from both sides of the insertion flap to be foldable, and unfolded to lock the rear flap after insertion of the locking flaps together with the insertion flap into the insertion hole, fracture guide cutting lines provided at the left and right flaps to guide fracture of the left and right flaps due to the locking flaps when the packing box is randomly opened, and opening guide cutting lines formed on the rear flap to separate the insertion flap and the rear flap from each other when the packing box is normally opened.

The fracture guide cutting lines may be formed at folded parts of the left and right flaps.

A finger insertion hole cutting line may be provided on the rear flap, and the opening guide cutting lines may be connected to the finger insertion hole cutting line.

A foldable fixed flap may be formed by the finger insertion hole cutting line, and the fixed flap may be inserted into the insertion slot.

The packing box may further include an elastic tape provided on the insertion flap and the locking flaps so as to traverse folded parts between the insertion flap and the locking flaps.

The object may include a developing cartridge.

The foregoing and/or other aspects and utilities of the present general inventive concept may also be achieved by providing a packing box which may include a body having a plurality of panels and a plurality of flaps extended from the corresponding panels to form a box shape, a first coupling unit formed on at least two of the flaps to be coupled to each other to form the box shape of the body in a first packing state, and a second coupling unit formed on at least two of the flaps to be coupled to each other to form the box shape of the body in a second packing state, wherein the body is in one of the first packing state and the second packing state.

The first coupling unit and the second coupling unit may be exclusively used such that the body is in one of the first packing state and the second packing state.

The first coupling unit may be used in the first packing state of the body, and the second coupling unit may be used in the second packing state of the body after the first coupling unit has been decoupled to unpack the box shape of the body.

At least a portion of the one of the flaps which has been used in the first packing state may be removed to form the second coupling unit.

The first coupling unit and the second coupling unit may not be simultaneously used to the first packing state and the second packing state.

At least a portion of the second coupling unit may be formed on the same flap of the first coupling unit, and another portion of the second coupling unit may be formed on the other flap in which the first coupling is not formed.

One of the at least two flaps may be shared by the first coupling unit and the second coupling unit, and the other one of the at least flaps may not be shared by the first coupling unit and the second coupling unit The plurality of flaps may include left, right, front, and rear flaps, and the first coupling unit may include the rear flap having an insertion flap and a locking flap, and the left and right flaps having a first portion to provide a first space to receive the insertion flap and a second portion to provide a second space to receive the insertion flap and the locking flap.

The locking flap may be foldable when being inserted into an opening inside the box shape through the second portion.

The locking flap may be unfoldable after being inserted into an opening inside the box shape.

The second coupling unit may include a fixed flap formed on the rear flap and an insertion slot formed on the front flap.

The insertion flap and the locking flap may be removed from the rear flap to form the fixed flap of the second coupling unit.

The front flap may be not used in the first coupling unit.

The first coupling unit may include one or more cutting lines to form the second coupling unit when a portion of the first coupling unit is cut off from a remaining portion of the first coupling unit along the cutting lines The packing box may further include an object disposed in an inside of the box shape of the body, and a recess portion formed on the object to provide a space between the box shape and the object such that a portion of the first coupling unit moved the inside of the box shape of the body.

One of the two flaps of the second coupling unit may include an insertion flap and a locking flap extended from the insertion flap, and the locking flap may be captured inside the box shape by the other flap of the second coupling unit.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
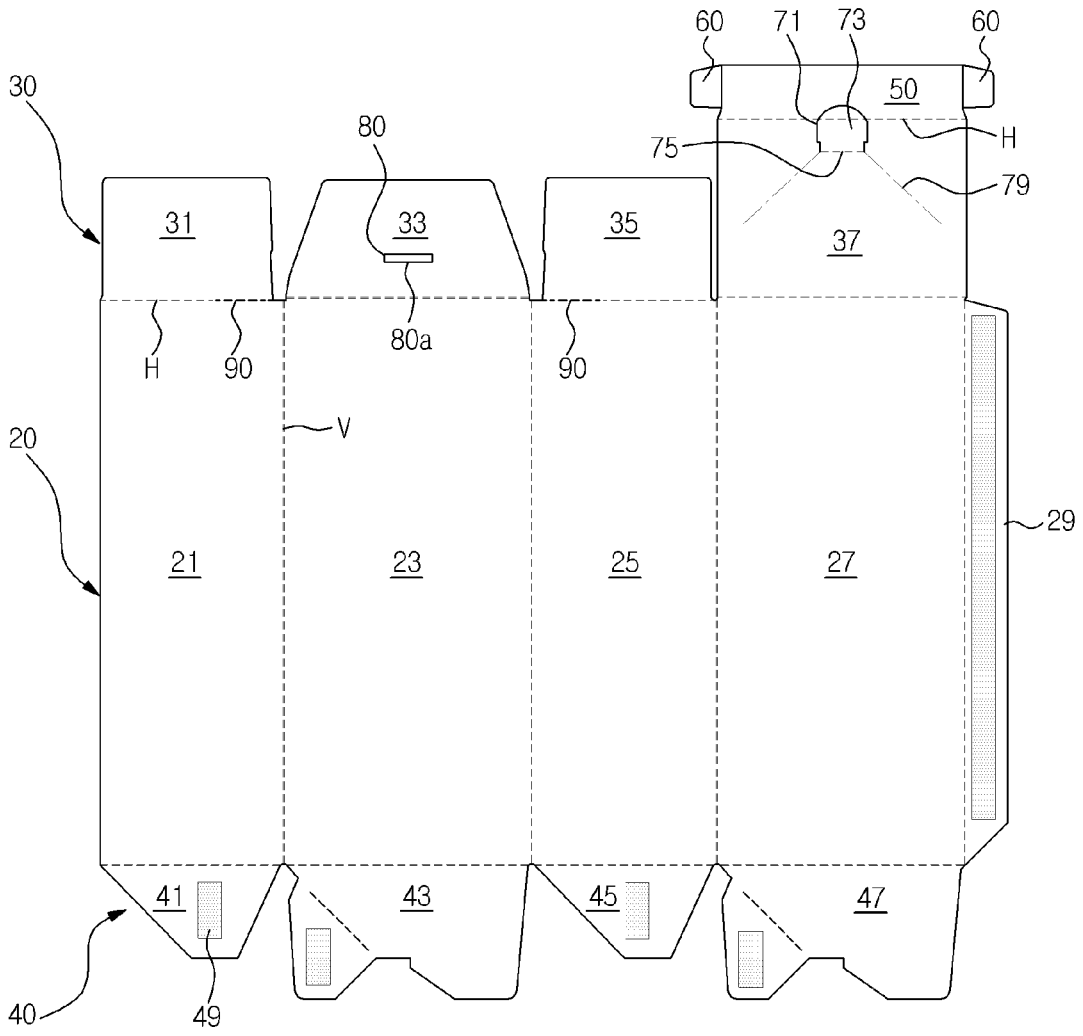
FIG. 1 is a development view of a packing box according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

Figure 2:
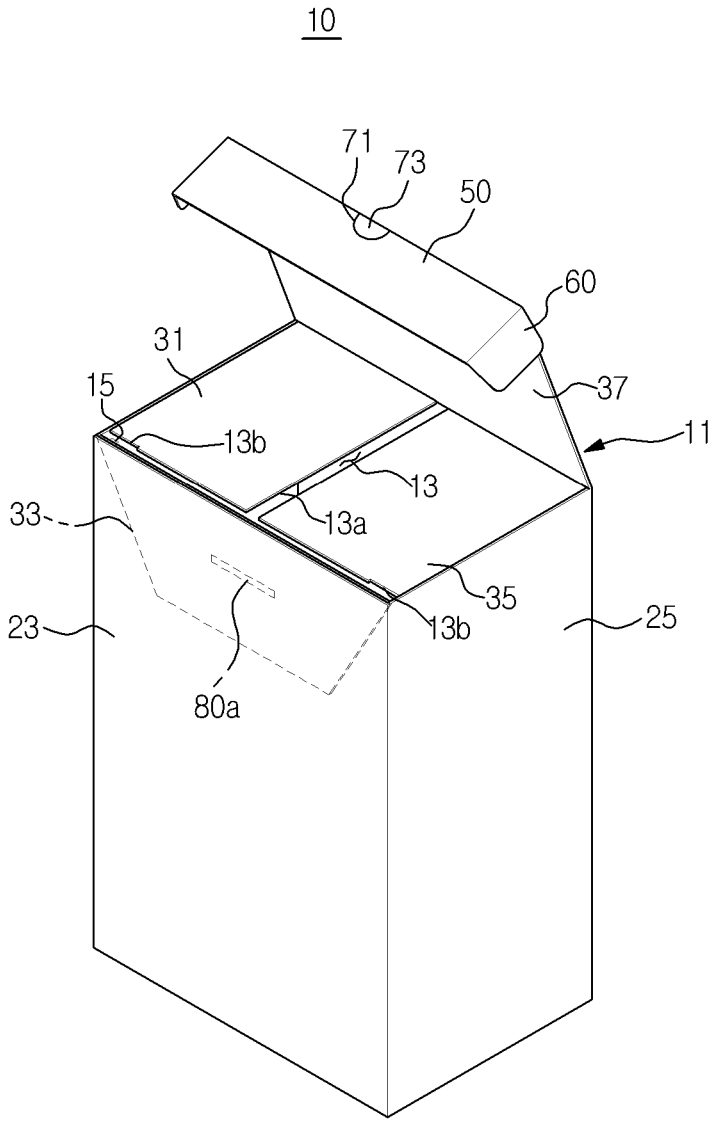
FIG. 2 is a perspective view illustrating an assembled state of the packing box of FIG. 1.

FIG. 1 is a development view illustrating a packing box 1 according to an embodiment of the present general inventive concept and FIG. 2 is a perspective view illustrating the packing box 1 assembled by folding or coupling corresponding panels and flaps of FIG. 1.

As illustrated in FIGS. 1 and 2, a packing box 1 in a developed state includes a main body 11 including a panel unit 20 and upper and lower flap units 30 and 40, which are divided from each other by horizontal folding lines H and vertical folding lines V.

The main body 11 is formed substantially in an regular hexahedral shape assembled by folding the panel unit 20 and the upper and lower flap units 30 and 40 along the horizontal folding lines H and the vertical folding lines V.

The panel unit 20 includes a left panel 21, a front panel 23, a right panel 25 and a rear panel 27, which are sequentially provided to form a square column.

An adhesive panel 29 may be extended from the rear panel 29 so as to adhere the rear panel 29 to the left panel 21 after the folding of the panel unit 20.

The upper and lower flap units 30 and 40 corresponding to each other are formed on the upper and lower ends of the panel unit 20, and adjacent flaps of the upper and lower flap units 30 and 40 are separated from each other.

The lower flap unit 40 includes a left flap 41, a front flap 43, a right flap 45 and a rear flap 47 extended from the lower ends of the respective panels 21, 23, 25 and 27 of the panel unit 20 and folded inwardly so as to be fixed to each other.

An adhesive part 49 to which an adhesive agent is attached is provided on each of the left, front, right and rear flaps 41, 43, 45 and 47. The respective flaps 41, 43, 45 and 47 are folded along the horizontal folding lines H, overlapped with each other, and then fixed to each other by the adhesive parts 49, thereby forming a bottom part of the packing box 10.

The upper flap unit 30 includes a left flap 31, a front flap 33, a right flap 35 and a rear flap 37 extended from the upper ends of the respective panels 21, 23, 25 and 27 of the panel unit 20.

The respective flaps 31, 33, 35 and 37 are folded inwardly along the horizontal folding lines H, and the adjacent flaps 31, 33, 35 and 37 are separated from each other.

The left and right flaps 31 and 35 are folded along the horizontal folding lines H and are extended in opposite directions so as to cover an opening 13 formed at the upper part of the main body 11, and the rear flap 37 is extended so as to cover the upper surfaces of the folded left and right flaps 31 and 35. Free terminals (or distal ends) of the left and right flaps 31 and 35 may be extended to a central part 13*a* of the opening 13 in a widthwise direction.

The rear flap 37 is extended to the edge of the upper end of the front panel 23, and an insertion flap 50 extended so as to be foldable is provided at the front end of the rear flap 37.

The insertion flap 50 is inserted into an insertion hole 15 formed between the edge of the upper end of the front panel 23 and the edges of the side surfaces of the left and right flaps 31 and 35.

Further, locking flaps 60 extended so as to be foldable are provided at both sides 50*a* of the insertion flap 50.

Figure 3:
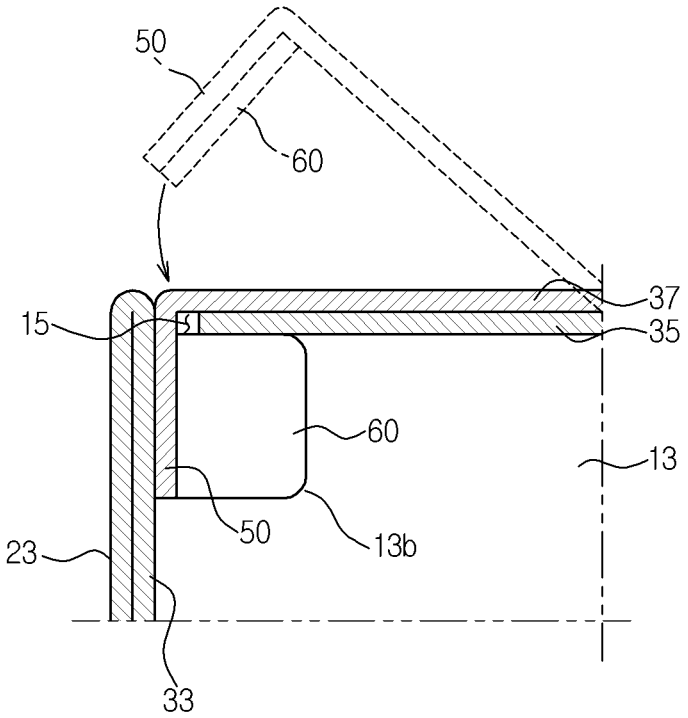
FIG. 3 is a view illustrating a locking structure of a fixed flap of the packing box of FIG. 1.

As illustrated in FIG. 3, after the locking flaps 60 together with the insertion flap 50 are inserted into the insertion hole 50 under the condition that the locking flaps 60 are folded so as to contact the insertion flap 50, the locking flaps 60 are naturally unfolded by self-elasticity thereof, thereby maintaining a closed state of the rear flap 37.

The locking flaps 60 are disposed at positions adjacent to left and right edge portions of the opening 13 to prevent the left and right flaps 31 and 35 from being separated from the opening 13. For this purpose, since the insertion flap 50 has a width corresponding to the width of the opening 13 and the locking flaps 60 are extended from both sides of the insertion flap 50, the locking flaps 60 are disposed at positions adjacent to the folded parts of the left and right flaps 31 and 35 by restoring force of the folded parts of the locking flaps 60.

If a locking flap 60 is formed at the central part of the insertion flap 50, the tips of both side edges of the rear flap 37 may be damaged due to separation of the left and right flaps 31 and 35 from the opening 13. However, the locking flaps 60 is formed according to the embodiment of the present general inventive concept to prevent such separation, thereby improving reliability.

The locking flap 60 is in a first unfolding state of an unassembled state of the packing box as illustrated in FIG. 1, is folded in a folding state as illustrated in a first assembled state of the packing box of FIGS. 2 and 3 to be inserted into the corresponding insertion hole 15 of the packing box, and then is unfolded in a second unfolding state as illustrated in FIG. 3 to prevent the insertion flap 50 and the rear flap 37 from being separated from a second assembled state of the packing box.

A finger insertion hole cutting line 71 is provided on the rear flap 37, so that a user presses with a finger or a tool to form a hole therefrom when the packing box 10 is opened from the second assembled state.

The finger insertion hole cutting line 71 may partially overlap with the horizontal folding line H of the insertion flap 50 to provide visibility to the user.

A fixed flap 73 having a designated shape is formed at an inside of the finger insertion hole cutting line 71. The fixed flap 73 is provided to be cut along the finger insertion hole cutting line 71 and then to be foldable along a rotary line 75.

Opening guide cutting lines 79 are extended from both sides of the rotary line 75 toward both side edges of the rear flap 37.

The opening guide cutting lines 79 serve to separate the insertion flap 50 locked by the locking flaps 60 and the rear part of the rear flap 37 from each other during opening of the packing box 10.

Such opening guide cutting lines 79 are extended from both ends of the rotary line 65 in directions distant away from each other up to positions adjacent to both side edges of the rear flap 37.

Further, an insertion slot 80 extended to a designated length in the horizontal direction is provided on the front flap 33. If the packing box 10 is opened and is then repacked, the fixed flap 73 cut along the finger insertion hole cutting line 71 is inserted into the insertion slot 80.

The insertion slot 80 in a cut-off state may be provided on the front flap 33, or the insertion slot 80 may be provided so as to allow a user to cut a portion of the front flap 33 along a cutting line 80*a* to form the insertion slot 80.

A fracture guide cutting line 90 to guide fracture of the left and right flaps 31 and 35 if the rear flap 37 locked by the locking flaps 60 is forcibly opened without use of the opening guide cutting lines 79 may be provided at the horizontal folding line H of each of the left and right flaps 31 and 35.

The fracture guide cutting lines 90 cause the horizontal lines H of the left and right flaps 31 and 35 to be easily damaged when the packing box 10 is randomly opened, thereby preventing illegal fraudulent use (unauthorized use or reuse) of the packing box 10.

Such fracture guide cutting lines 90 are extended from positions adjacent to both ends of the horizontal folding line H of the front flap 33 to a designated length.

Figure 4:
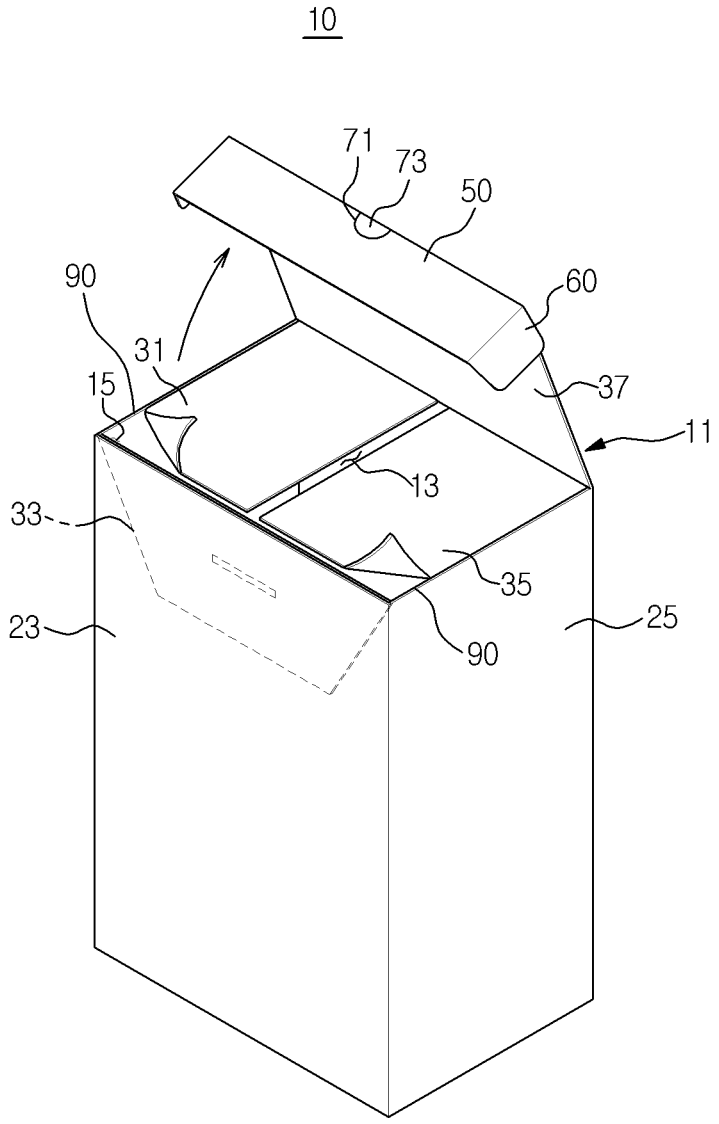
FIG. 4 is a view illustrating a damaged state of the packing box when the packing box is randomly opened according to an embodiment of the present general inventive concept.

When a user forcibly opens the packing box 10, the left and right flaps 31 and 35 are lifted by the locking flaps 60, as illustrated in FIG. 4, and thereby, the fracture guide cutting lines 90 may be formed at the horizontal folding lines H of the left and right flaps 31 and 35 such that portions of the left and right flaps 31 and 35 are cut off from the panels 21 and 25.

Therefore, the locking flaps 60 move upwards through gaps formed between the left and right flaps 31 and 35 and the panel unit 20 and thus the packing box 10 is opened. However, if the packing box 10 is repacked, the locking flaps 60 are not supported by the lower surfaces of the left and right flaps 31 and 35 and thus reuse of the packing box 10 may not be possible.

Hereinafter, a method of opening and repacking a packing box according to an embodiment of the present general inventive concept will be described with reference to FIGS. 5A to 5F.

The packing box may be provided as illustrated in FIG. 1. When an object to be packed is put into the packing box 10, the packing box 10 of FIG. 1 may be assembled by forming the bottom part of the packing box 10 and overlapping the flaps of the lower flap unit 40 with each other and then fixing each other through the adhesive agent, as illustrated in FIG. 2.

An object is put into the packing box 10 through the opening 13 under the condition that the opening 13 of the packing box 10 is opened, and then the left and right flaps 31 and 35 are folded to cover the opening 13. In this embodiment, the object to be packed may include a developing cartridge, for example. The developing cartridge is usable to form an image on a print medium in an image forming apparatus, and includes a housing provided with a developer and various rollers. Here, the housing is detachably provided in the image forming apparatus. In such a developing cartridge, design of a packing box to prevent illegal fraudulent use (or unauthorized use) is important.

Thereafter, the rear flap 37 is folded to overlap with the upper surfaces of the left and right flaps 31 and 35 folded to cover the opening 31, and the insertion flap 50 is inserted into the insertion hole 15.

Figure 5A:
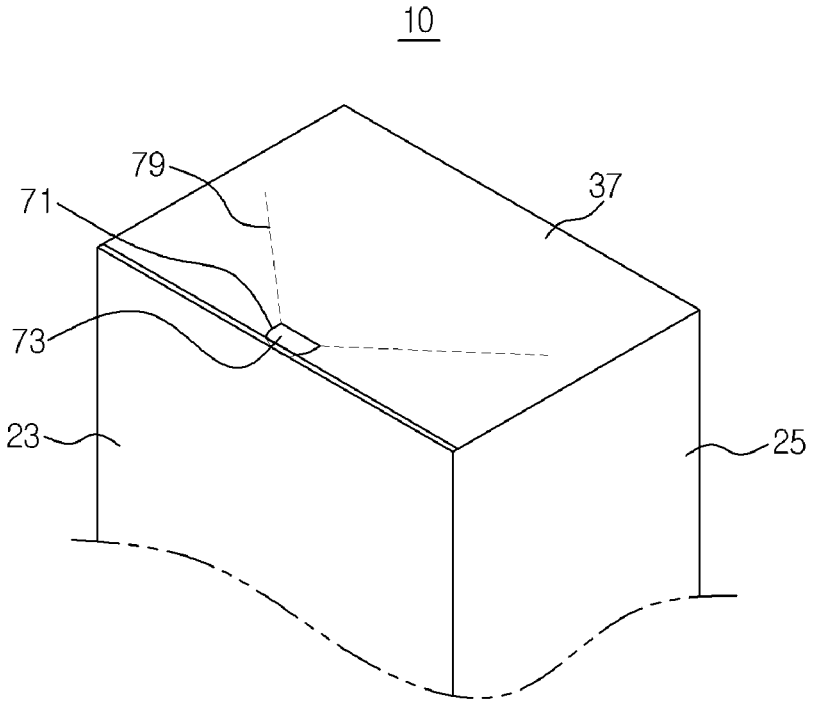
FIGS. 5A to 5F are views illustrating a process of opening and repacking of the packing box according to an embodiment of the present general inventive concept.

At this time, when the locking flaps 60 are forcibly folded to contact the rear surface of the insertion flap 50, and then the folded locking flaps 60 together with the insertion flap 50 are inserted into the insertion hole 15. The locking flaps 60 inserted into the insertion hole 15 are unfolded by self-elasticity thereof, thereby fixing the rear flap 37 with respect to the flaps 31 and 35. Therefore, the packing box 10 maintains a sealed state, as illustrated in FIG. 5A.

Here, the finger insertion hole cutting line 71 is formed at a position adjacent to the front end of the rear flap 37 forming the upper surface of the packing box 10, and the opening guide cutting lines 79 are formed at the rear of the finger insertion hole cutting line 71.

Figure 5B:
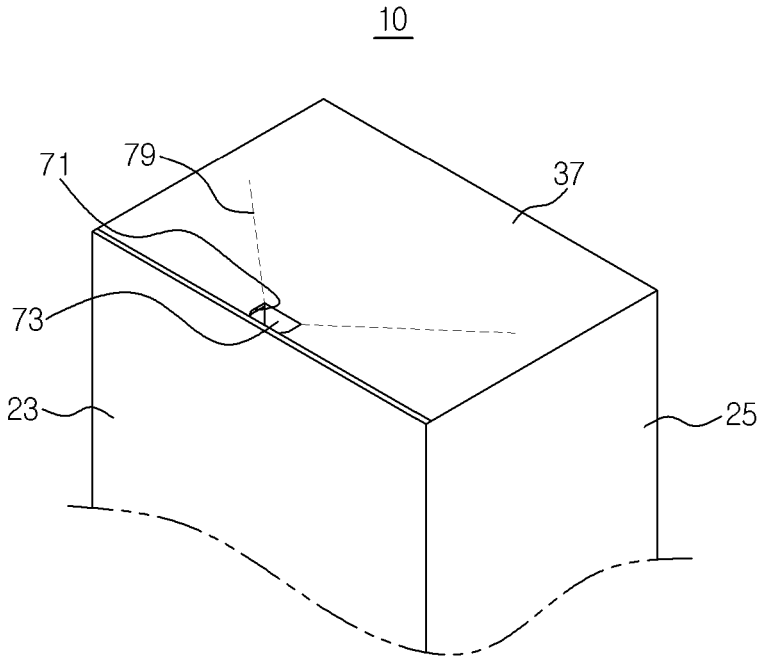

If a user wants to open the above-describe assembled packing box 10 in the sealed state, the user applies a designated force to a position around the finger insertion hole cutting line 71. Then, the finger insertion hole cutting line 71 is cut, thus forming a designated hole, as illustrated in FIG. 5B.

Figure 5C:
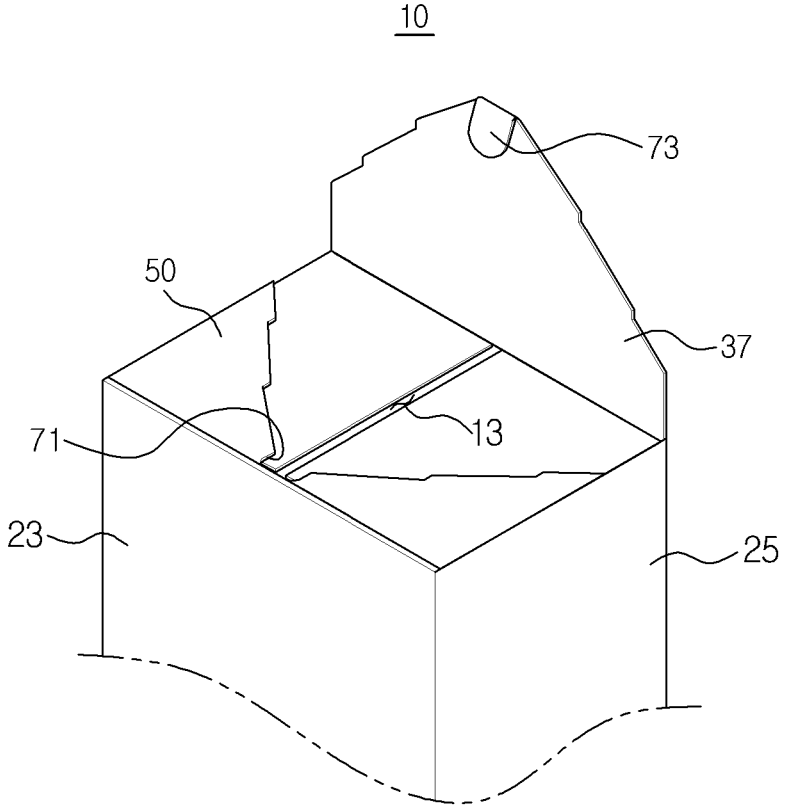
Figure 5D:
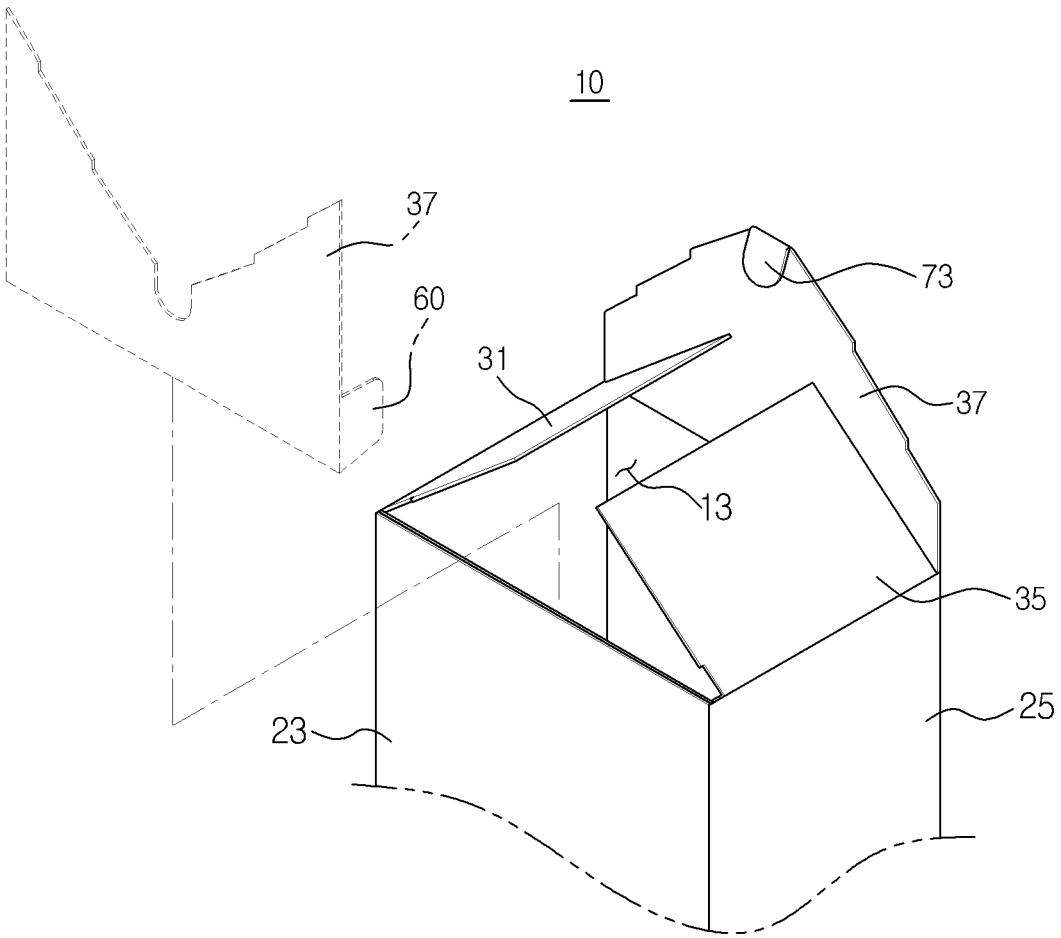

Thereafter, when the user lifts the rear flap 37 through the hole, the rear part of the rear flap 37 is cut along the opening guide cutting lines 79 and lifted, as illustrated in FIG. 5C, and then the front part and the rear part of the rear flap 37 are separated from each other and thus the front part of the rear flap 37 provided with the insertion flap 50 is removed from the packing box 10, as illustrated in FIG. 5D.

Thereby, the object may be taken out of the inside of the packing box 10 through the opening 13.

Figure 5E:
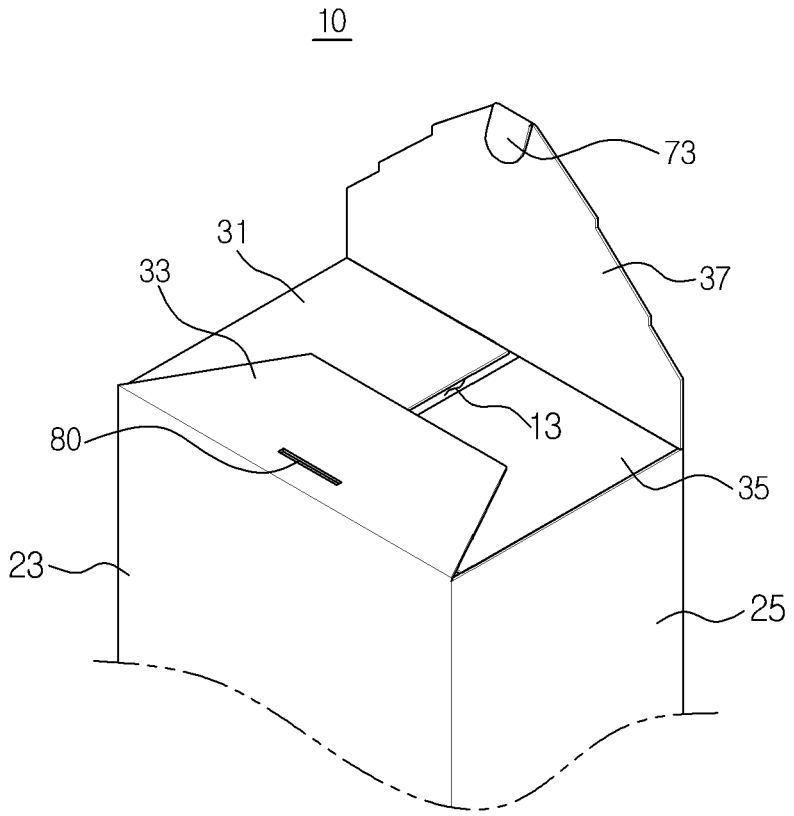

Thereafter, if the user wants to repack the opened packing box 10, the user folds the left and right flaps 31 and 35 to cover the opening 13 under the condition that the front flap 33 folded to an inner surface of the front panel 23 is taken out of the opening 13, as illustrated in FIG. 5E. Then, when the user folds the front flap 33 to overlap with the upper surfaces of the folded left and right flaps 31 and 35, the insertion slot 80 formed on the front flap 33 is exposed.

Figure 5F:
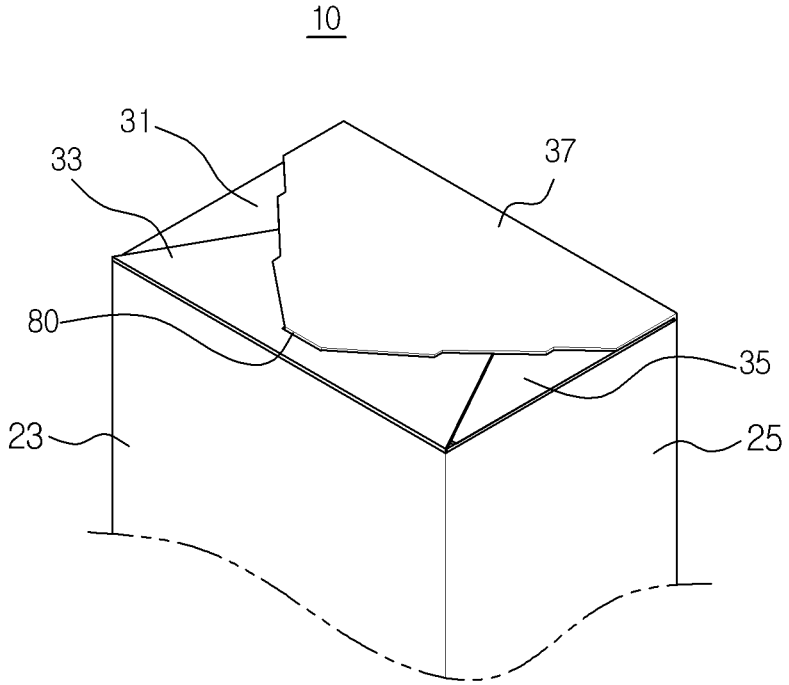

Thereafter, when the user folds the rear flap 37 to overlap with an upper surface of the front flap 33, the fixed flap 73 formed by cutting the rear flap 37 along the finger insertion hole cutting line 71 is located above the insertion slot 80. Then, when the user inserts the fixed flap 73 into the insertion slot 80, as illustrated in FIG. 5F, the front flap 33 and the rear flap 37 are fixed to each other, thereby achieving repacking of the packing box 10.

According to an embodiment of the present general inventive concept, it is possible for a user to recognize an opening of the packing box 10, that is, to recognize that the packing box 10 has been opened once.

Figure 6:
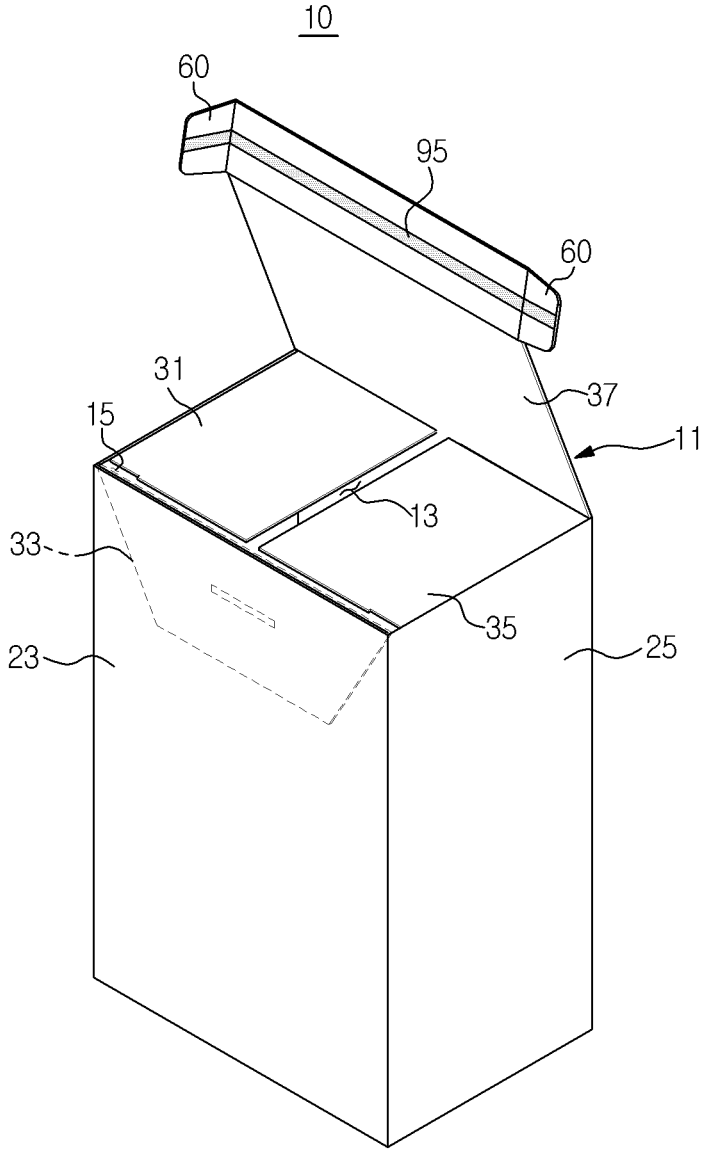
FIG. 6 is a perspective view illustrating a packing box according to an embodiment of the present general inventive concept.

FIG. 6 is a perspective view illustrating a packing box according to an embodiment of the present general inventive concept, the packing box of FIG. 6 is substantially the same as the packing box of FIGS. 1-5F. Therefore, detail descriptions thereof will be omitted.

Referring to FIG. 6, an elastic tape 95 is provided on the inner surfaces of the insertion flap 50 and the locking flaps 60 to seal the rear flap 37 and/or to traverse folded parts between the insertion flap 50 and the locking flaps 60.

The elastic tape 95 may be formed of a shape memory material, such as a shape memory polymer tape, and be provided to apply an elastic force in a direction of unfolding the locking flaps 60 with respect to the insertion flap 60.

The elastic tape 95 may have an elastic force greater than the elastic force of a material of the packing box 10.

When the locking flaps 60 together with the insertion flap 50 are inserted into the opening 13 through the insertion hole 15 of the packing box 10, the folded parts of the locking flaps 60 are rapidly unfolded within the opening 13 by an elastic force of the elastic tape 95, and thus a locking force to fix the rear flap 37 with respect to the packing box 10 is improved and a restoring force of the folded parts of the locking flaps 60 is prevented from being reduced even if the folded parts are repeatedly folded, thereby continuously maintaining a locking function.

Although not illustrated in the packing box of FIG. 1, it is possible that one or more handing or carrying opening formed on corresponding ones of the panels 21-27 to accommodate a user hand or a moving toll to move or carry the packing box. Since this structure is well known in the packing box, detail descriptions will be omitted.

It is possible that the above-described handling or carrying openings may be formed on a panel, for example, the rear panel 27 formed with the rear flap 37 having the insertion flap 50 and the locking flap 60. However, it is possible that the handling or carrying openings may not be formed on a panel, for example, the rear panel 27 formed with the rear flap 37 having the insertion flap 50 and the locking flap 60, but may be formed on other flaps, for example, the left and right panels 21 and 25.

Figure 7A:
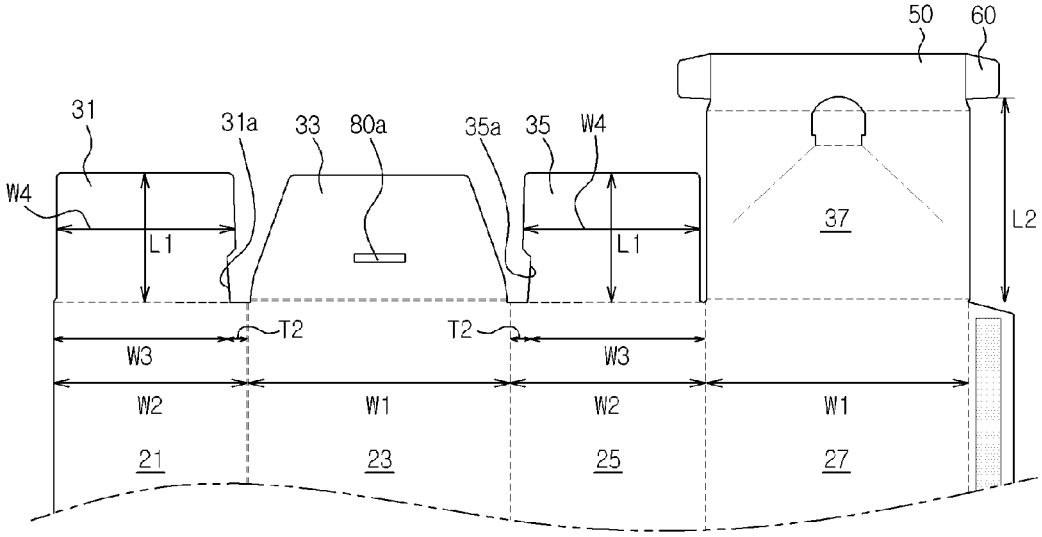
FIGS. 7A-7D are views illustrating a first coupling unit of a packing box according to an embodiment of the present general inventive concept.
Figure 7B:
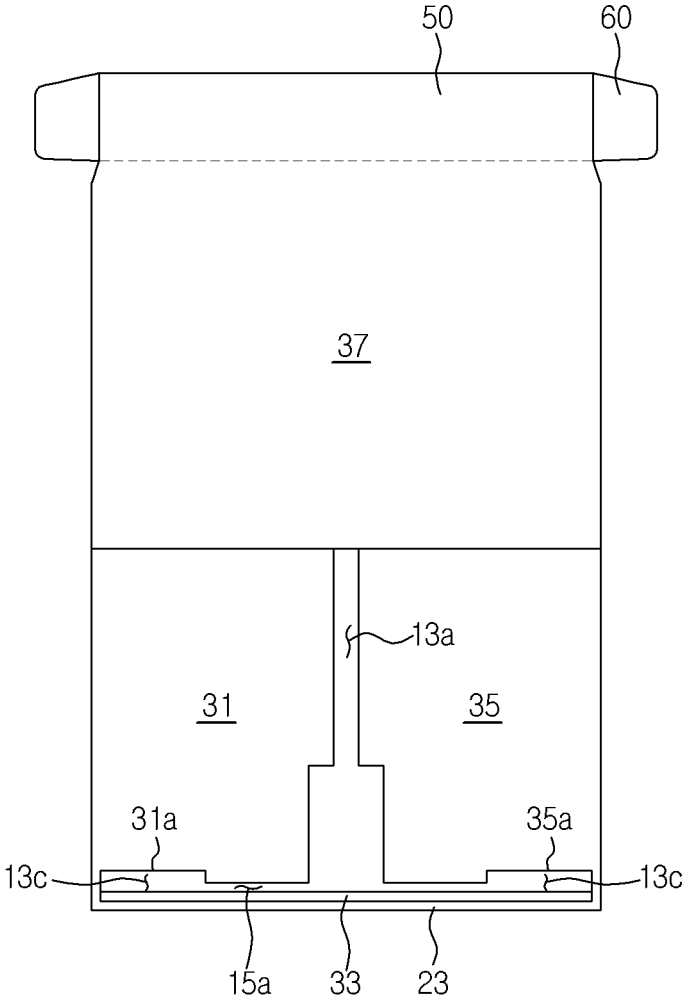

FIGS. 7A through 7D are views illustrating a first coupling unit of the packing box according to an embodiment of the present general inventive concept. Referring to FIG. 7A, the left panel 21 and the right panel 25 may have a width W2 and the front panel 23 and the rear panel 27 may have a width W1. The left flap 31 and the right flap 35 may have a length L1, and the rear flap 37 may have a length L2. And the length L2 may correspond to the width W2. The left flap 31 and the right flap 35 may have a recess portion 31*a* and 35*a*. Therefore, the left flap 31 and the right flap 35 may have a width W3 to form the recess portions 31*a* and 35*a*. The recess portions 31*a* and 35*a* may form a first space with the front flap 33 and/or the front panel 23 to correspond to a space 13*c* of the opening 13. The left flap 31 and the right flap 35 may also have a width W4 to form a second space with the front flap 33 and/or the front panel 23 to correspond to a first space 15*a* to receive the insertion flap 50, as illustrated in FIG. 7B.

Figure 7C:
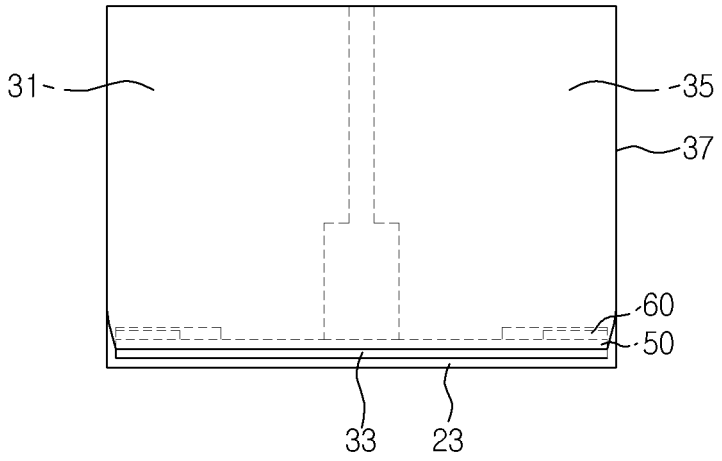

Referring to FIGS. 7B and 7C, the locking flaps 60 are folded to the insertion flap 50 to be in a folded state. The folded locking flaps 60 are inserted into the opening 13 through the space 13*b* thereof when the insertion flap 50 is inserted into the space 15*a*.

Figure 7D:
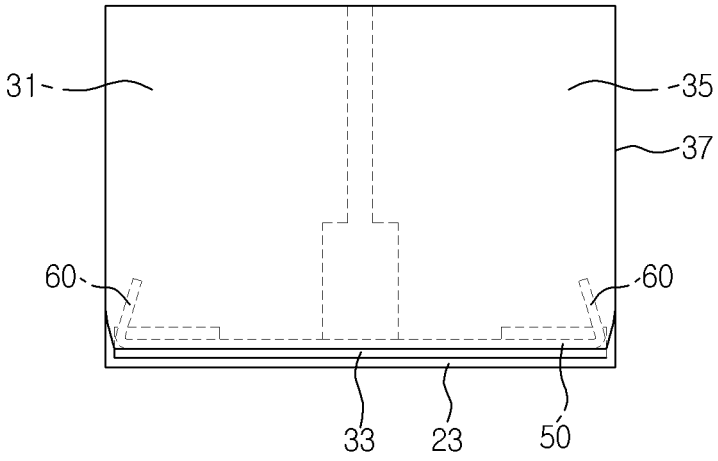

Referring to FIGS. 7C and 7D, the locking flaps 60 are changed and unfolded from the insertion flap 50, that is, from the folded state to an unfolded state. Since the locking flaps 60 is prevented from moving upward toward the left and right flaps 31 and 35 and the rear flap 37, the packing box is in a locking state or a sealing state.

Figure 8A:
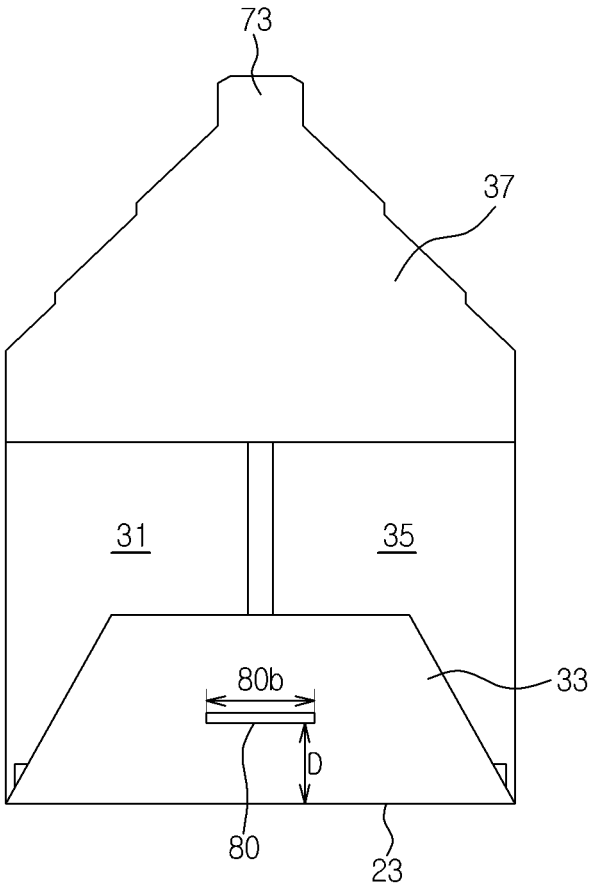
FIGS. 8A and 8B are views illustrating a second coupling unit of a packing box according to an embodiment of the present general inventive concept.
Figure 8B:
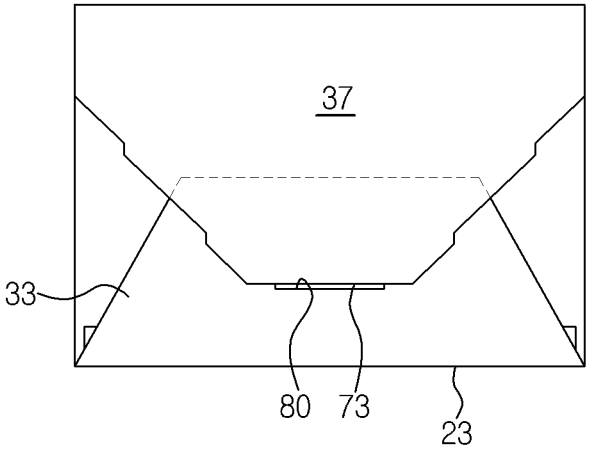

FIGS. 8A and 8B are views illustrating a second coupling unit of the packing box according to an embodiment of the present general inventive concept. The packing box of FIG. 1 is changed to the packing box of FIG. 8A by removing a portion of the front flap 33 along the cutting line 80*a* to form an insertion slot 80 and by removing a portion of the rear flap 37 along the cutting lines 71 and 79 to form a fixed flap 73. The front flap 33 may be disposed over the left and right flaps 31 can 35. The insertion slot 80 may have a length 80*b* to correspond to a dimension of the fixed flap 73 to form a second coupling state of the second coupling unit. The insertion slot 80 may also be disposed to be spaced apart from the front panel 23 by a distance D such that the fixed flap 73 is inserted into a space through the insertion slot 80 when the rear flap 37 covers the front flap 33 in a second locking state or a second sealing state.

When the fixed flap 73 is inserted through the insertion slot 80, a distal end of the fixed flap 73 may be disposed in a space between the front flap 23 and the left and right flaps 31 and 35. It is possible that the distal end of the fixed flap 73 may be bent to be supported by the front flap 23 and the left and right flaps 31 and 35. A location and dimension of the insertion slot 80 and the fixed flap 73 may be changed with respect to the font flap 23 according to a design and preference.

Figure 9A:
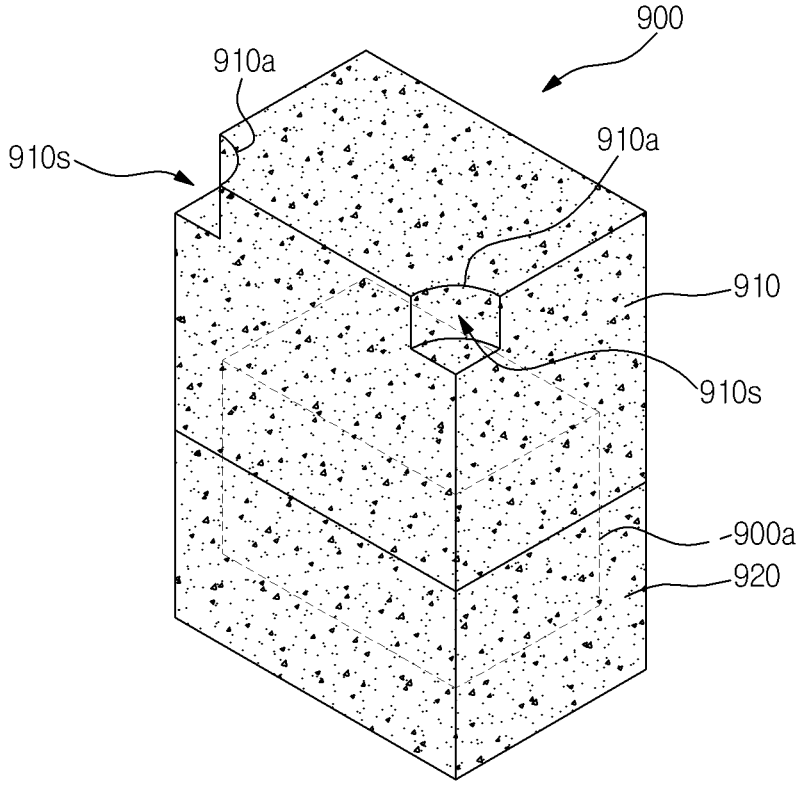
FIGS. 9A, 9B, and 9C are views illustrating an object and a packing box according to an embodiment of the present general inventive concept.
Figure 9B:
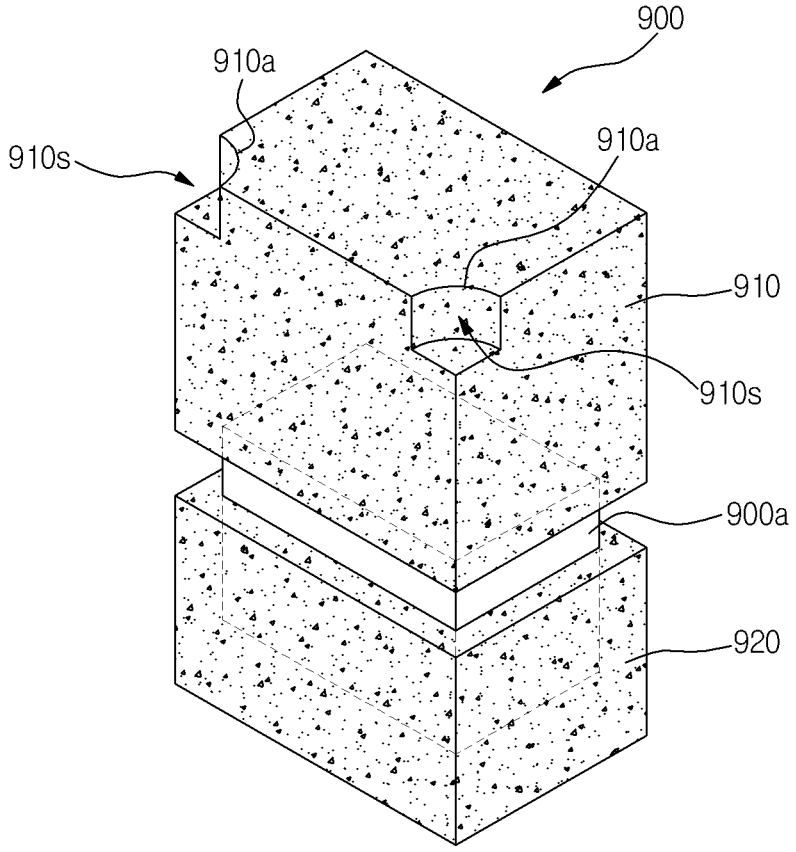

FIGS. 9A and 9B illustrate an object 900 to be included in the packing box according to an embodiment of the present general inventive concept. The object 900 may include a product 900*a* and upper and lower covers 910 and 920. The upper cover 910 and the lower cover 920 may be formed in a hexahedron or polyhedron. The upper cover 910 and the lower cover 920 may have an inside surface to correspond to an external appearance of the product 900*a*. Since the object 900 is disposed inside the packing box, the upper cover 910 of the object 900 may have recess portions 910*a* to provide a space 910S to accommodate a movement of the locking flap 60 such that the locking flap 60 can move between the folding state and the unfolding state in the opening 13 of the packing box. Although most portions of the opening 13 is filled with the object 900, the packing box may form at least a space with the object 900 to provide a space for the locking flap 60 to move in the locking or sealing state. The recess portions of 910*a* may have one of different shapes and dimensions as illustrated in FIGS. 9A and 9B according to a design and preference. It is also possible that the recess portions 910*a* may be formed in one of the upper cover 910 and the lower cover 920. It is also possible that the object 900 may not have the upper and lower covers 91 and 920. In this case, the external appearance of the product 900*a* may have at least a portion corresponding to the space 910S.

Figure 9C:
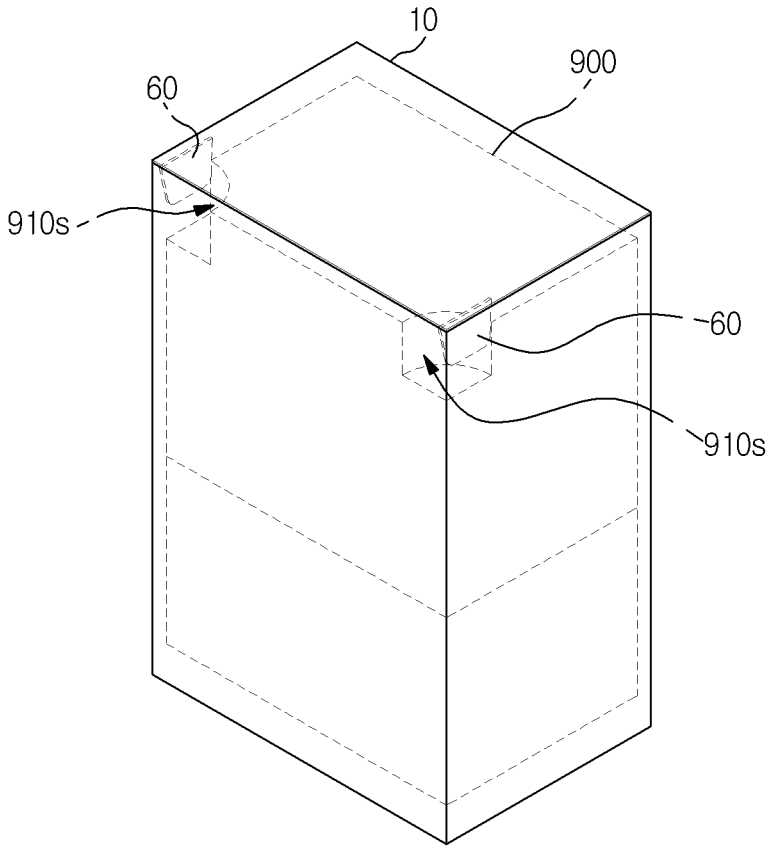

Referring to FIG. 9C, a packing box 10 includes the object 900 such that the locking flaps 60 are disposed in the space 910S formed between the packing box 10 and the object 900.

According to the embodiment illustrated above, the packing box includes a first coupling unit formed with a combination of at least the locking flap 60 and left and right flaps 31 and 35, and a second coupling unit formed with a combination of at least the fixed flap 73 and the insertion slot 80 of the front flap 33. When the first coupling unit is used to pack an object in the packing box, the second coupling unit is not used. Also when the second coupling unit is used to pack an object in the packing box, at least a portion of the first coupling unit is removed to provide a space in which the second coupling unit is used for packing. However, when the first coupling unit is used for packing, the second coupling is not removed but unused for packing.

As illustrated above, a packing box according to an embodiment of the present general inventive concept includes one or more parts, which are fractured, detached, or damaged when the packing box is opened, so as to prevent illegal fraudulent use (unauthorized use) and is reused after opening so as to improve convenience of use.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A packing box comprising:

a main body having a regular hexahedral shape to store and transport an object;

an opening formed on one surface of the main body such that the object is inserted into the main body through the opening;

a left flap and a right flap extended from left and right edges of the opening in an opposite direction to cover the opening;

a rear flap extended from a rear edge of the opening to be folded to upper surfaces of the left and right flaps;

an insertion flap extended from a front end of the rear flap to be inserted into an insertion hole formed between a front edge of the opening and side edges of the left and right flaps;

locking flaps foldably connected to both sides of the insertion flap to maintain a closed state of the rear flap, the locking flaps being configured to be folded and inserted together with the insertion flap into the insertion hole, and further configured to unfold after being inserted in the insertion hole to be supported by the left and right flaps; and fracture guide cutting lines having a designated length and formed at folded parts of the left and right flaps to guide fracture of the left and right flaps if the insertion flap is removed from the opening after the locking flaps have been inserted into the insertion hole and unfolded.

2. The packing box according to claim 1, wherein the insertion flap has a width corresponding to a width of the opening.

3. The packing box according to claim 1, wherein the fracture guide cutting lines are disposed at positions adjacent to the locking flaps.

4. The packing box according to claim 1, wherein a finger insertion hole cutting line is provided on the rear flap.

5. The packing box according to claim 4, wherein opening guide cutting lines extended from the finger insertion hole cutting line in leftward and rightward directions of the rear flap are provided on the rear flap to separate the insertion flap from the rear flap.

6. The packing box according to claim 5, further comprising:

a front flap extended from the front edge of the opening to be foldable over the opening, wherein an insertion slot extended in the horizontal direction is provided on the front flap so as to be cut along a cutting line.

7. The packing box according to claim 6, wherein a foldable fixed flap is formed by the finger insertion hole cutting line, and the fixed flap is inserted into the insertion slot.

8. The packing box according to claim 1, further comprising:

an elastic tape provided on the insertion flap and the locking flaps to traverse folded parts between the insertion flap and the locking flaps.

9. The packing box according to claim 8, wherein the elastic tape includes a shape memory material.

10. The packing box according to claim 9, wherein the elastic tape is provided to apply an elastic force in a direction of unfolding the locking flaps.

11. The packing box according to claim 10, wherein the elastic force of the elastic tape is greater than an elastic force of a material of the packing box.

12. A packing box comprising:

a main body provided with an opening formed on one surface thereof such that an object is inserted into the main body through the opening;

a left flap and a right flap extended from left and right edges of the opening opposite to each other to cover the opening;

an insertion hole formed between a front edge of the opening and side edges of the left and right flaps adjacent to the front edge of the opening;

a rear flap extended from a rear edge of the opening to be foldable and contacting upper surfaces of the left and right flaps;

a front flap extended from the front edge of the opening to be foldable over the opening and provided with an insertion slot;

an insertion flap extended from the front end of the rear flap to be foldable and inserted into the insertion hole;

locking flaps extended from both sides of the insertion flap to be foldable, and unfolded to lock the rear flap after insertion of the locking flaps together with the insertion flap into the insertion hole;

fracture guide cutting lines provided at the left and right flaps to guide fracture of the left and right flaps due to the locking flaps when the packing box is randomly opened; and opening guide cutting lines formed on the rear flap to separate the insertion flap and the rear flap from each other when the packing box is normally opened.

13. The packing box according to claim 12, wherein the fracture guide cutting lines are formed at folded parts of the left and right flaps.

14. The packing box according to claim 12, wherein a finger insertion hole cutting line is provided on the rear flap, and the opening guide cutting lines are connected to the finger insertion hole cutting line.

15. The packing box according to claim 14, wherein a foldable fixed flap is formed by the finger insertion hole cutting line, and the fixed flap is inserted into the insertion slot.

16. The packing box according to claim 12, further comprising an elastic tape provided on the insertion flap and the locking flaps so as to traverse folded parts between the insertion flap and the locking flaps.

17. The packing box according to claim 12, wherein the object includes a developing cartridge.

18. A packing box comprising:

a body having a plurality of panels and a plurality of flaps extended from the corresponding panels to form a box shape;

a first coupling unit formed on at least two of the flaps to be coupled to each other to form the box shape of the body in a first packing state, at least one of the flaps of the first coupling unit being configured to be folded to form the box shape of the body in the first packing state and subsequently unfold to maintain the first packing state, such that one or more of the flaps of the first coupling unit fractures when the first packing state is ended; and a second coupling unit formed on at least two of the flaps to be coupled to each other to form the box shape of the body in a second packing state after the first packing state has been ended, the second coupling unit being formed on at least one flap that the first coupling unit is not formed on, wherein the body is in one of the first packing state and the second packing state, wherein the plurality of flaps comprises left, right, front, and rear flaps; and the first coupling unit comprises the rear flap having an insertion flap and a locking flap, and the left and right flaps having a first portion to provide a first space to receive the insertion flap and a second portion to provide a second space to receive the insertion flap and the locking flap.

19. The packing box of claim 18, wherein the first coupling unit and the second coupling unit are exclusively used such that the body is in one of the first packing state and the second packing state.

20. The packing box of claim 18, wherein:

the first coupling unit is used in the first packing state of the body; and the second coupling unit is used in the second packing state of the body after the first coupling unit has been decoupled to end the first packing state.

21. The packing box of claim 18, wherein at least a portion of the one of the flaps which has been used in the first packing state is removed to form the second coupling unit.

22. The packing box of claim 18, wherein the first packing state and the second packing state are not used simultaneously.

23. The packing box of claim 18, wherein:

at least a portion of the second coupling unit is formed on the same flap as the first coupling unit; and another portion of the second coupling unit is formed on the at least one flap that the first coupling unit is not formed on.

24. The packing box of claim 18, wherein:

one of the plurality of flaps is shared by the first coupling unit and the second coupling unit; and another one of the plurality of flaps is not shared by the first coupling unit and the second coupling unit.

25. The packing box of claim 18, wherein the locking flap is foldable when being inserted into an opening inside the box shape through the second portion.

26. The packing box of claim 18, wherein the locking flap is unfoldable after being inserted into an opening inside the box shape.

27. The packing box of claim 18, wherein the second coupling unit comprises a fixed flap formed on the rear flap and an insertion slot formed on the front flap.

28. The packing box of claim 27, wherein the insertion flap and the locking flap are removed from the rear flap to form the fixed flap of the second coupling unit.

29. The packing box of claim 27, wherein the front flap is not used in the first coupling unit.

30. The packing box of claim 18, wherein the first coupling unit comprises one or more cutting lines to form the second coupling unit when a portion of the first coupling unit is cut off from a remaining portion of the first coupling unit along the cutting lines.

31. The packing box of claim 18, further comprising:

an object disposed in an inside of the box shape of the body; and a recess portion formed on the object to provide a space between the box shape and the object to accommodate a movement of a portion of the first coupling unit inside of the box shape of the body.

32. The packing box of claim 31, wherein one of the two flaps of the second coupling unit comprises an insertion flap and a locking flap extended from the insertion flap, and the locking flap is captured inside the box shape by the other flap of the second coupling unit.

* * * * *